United States Patent [19]

Ullman

[11] 4,264,945

[45] Apr. 28, 1981

[54] VERTICAL INDICIA DISPLAYING AND ENERGY SUPPLY COLUMN

[76] Inventor: Allan Ullman, Sea Cliff, N.Y.

[21] Appl. No.: 18,153

[22] Filed: Mar. 7, 1979

[51] Int. Cl.[3] ..... F21S 1/02

[52] U.S. Cl. ..... 362/147; 362/388; 362/410; 362/431; 362/812; 174/49; 174/95

[58] Field of Search ..... 362/431, 410, 414, 812, 362/370, 371, 382, 388, 147, 152; 174/97, 95, 96, 49

[56] References Cited

U.S. PATENT DOCUMENTS

| | | | |
|---|---|---|---|
| 272,833 | 2/1883 | Goodfellow | 174/95 |
| 2,559,639 | 7/1951 | Kruger | 362/217 |
| 3,116,027 | 12/1963 | Kleppin | 362/410 |
| 3,375,620 | 4/1968 | Phillips | 362/431 |
| 3,521,047 | 7/1970 | Smith | 362/431 |
| 3,609,211 | 9/1971 | Van Herk | 174/49 |
| 3,777,138 | 12/1973 | Metzler | 362/431 |
| 3,805,055 | 4/1974 | Cassey | 362/431 |
| 4,166,195 | 8/1979 | Schwab | 174/95 |

*Primary Examiner*—Monroe H. Hayes

*Attorney, Agent, or Firm*—Eugene E. Geoffrey, Jr.

[57] ABSTRACT

A vertical indicia displaying and electric energy supply column which includes a tubular column, a light fixture carried by the column and which is formed at least in part of a light transmitting material having indicia thereon. Electric wiring for the light fixture as well as energy supplying and communication outlets on the column is positioned within the column and partitions are provided to physically and electrically isolate the communication wiring from the wiring for the light fixture and the energy supplying outlet.

1 Claim, 12 Drawing Figures

VERTICAL INDICIA DISPLAYING AND ENERGY SUPPLY COLUMN

This invention relates to a novel and improved vertical indicia displaying and energy supply column and more specifically a structure particularly useful among other things as means for lighting and identification of stations such as check-out counters and the like in commercial establishments and providing convenient means for power outlets, computer and communication terminals and the like.

In offices, stores and other commercial establishments needs arise for specific lighting requirements such as means for displaying indicia, power outlet and communication facilities and the like. This necessitates the installation of cables, often of an exposed nature, in order to provide facilities not often considered in original construction. One example of such requirements are check-out counters which supermarkets, department stores and retail outlets find most economical in handling information such as purchases, stock control and taxes. In such cases, means must be provided for visual identification of each counter, power outlets for electrical equipment and communication cables for telephones and public address systems, computerized registers and the like. As a result, substantial renovation is often required to install power lines and communication cables which is expensive and time consuming.

This invention overcomes the difficulties heretofore encountered and provides a novel and improved structure which may be readily installed at any desired location such as checkout counters and the like and provide means for identification, computer and telephone terminals, etc. with minimum installation problems and expense, particularly since most buildings are provided with suspended ceilings which provide ample space for housing the electric wiring and cables.

Still another object of the invention resides in the provision of a novel and improved indicia displaying column which can be readily installed at any desired location and provided with adequate means for identification, illumination and connection of computerized registers and voice communicating devices such as telephones and the like.

Still another object of the invention resides in the provision of a novel and improved column embodying means for providing longitudinal compartments therein to isolate energy supplying cables from computer and telephone cables.

Still another object of the invention resides in a novel and improved prewired column which may be readily installed in stores, offices and other commercial establishments and provide means for identification and connection of a variety of desired electrical services.

Another object of the invention resides in the provision of a novel and improved column and lighting fixture carried thereby which may be utilized for displaying information and providing task illumination and the like.

The indicia displaying column in accordance with the invention comprises a vertically disposed column having means at the bottom thereof for anchoring it either to the floor or to another object such as a counter, desk or the like. The column may extend upwardly through a suspended ceiling and means are provided for anchoring it to the ceiling such as the T-bars or other ceiling supporting means. The top of the column includes appropriate electric boxes for connection of power lines and cables for communication and other purposes and may also include means for separating high and low voltage lines. An indicia displaying light fixture for identification is affixed to the column and appropriate outlets and connectors are provided for powering electrical devices and connection of computer type registers and communication systems if desired.

The above and other objects and advantages of the invention will become more apparent from the following description and accompanying drawings forming part of this application.

IN THE DRAWINGS

As pointed out above, this invention is useful for a variety of purposes certain of which utilize all of the facilities offered thereby while others may utilize only certain of the advantages. For the purpose of this application therefore, the invention will be described in connection with check-out counters in commercial establishments since this application requires in general the utilization of substantially all of the advantages offered.

Figure 1:
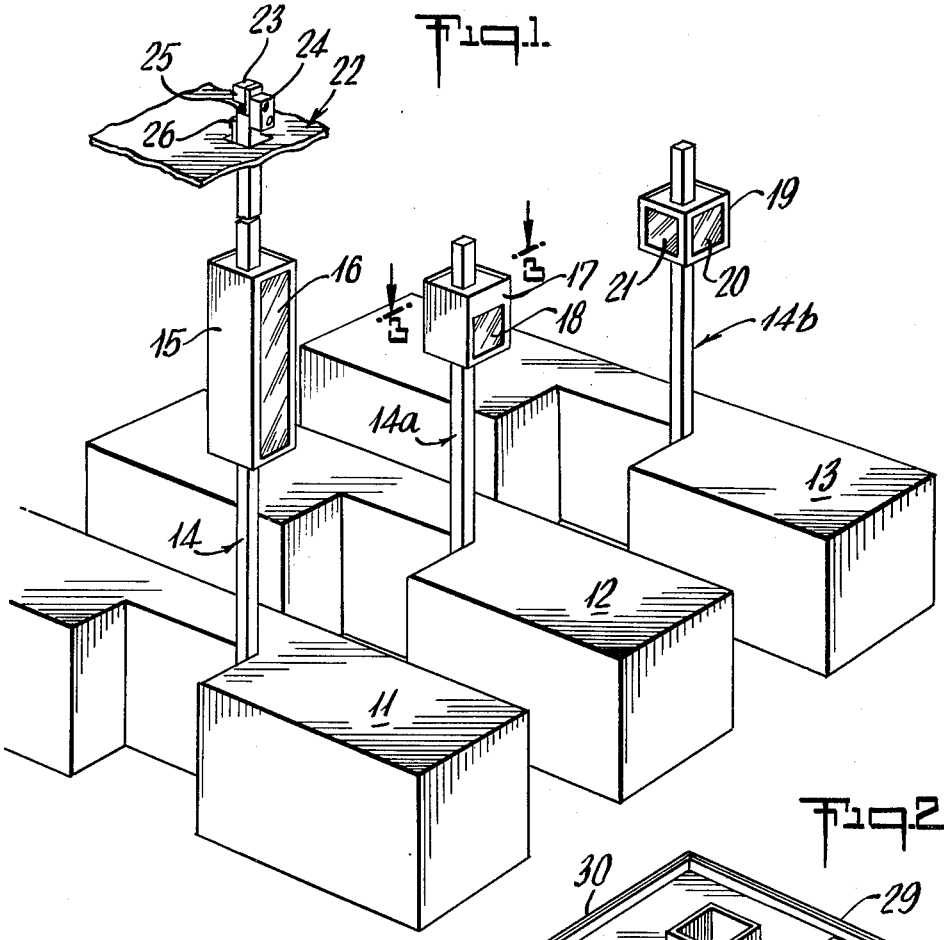
FIG. 1 is a perspective view of several of one form of the invention particularly useful in connection with check-out counters in commercial establishments.
Figure 2:
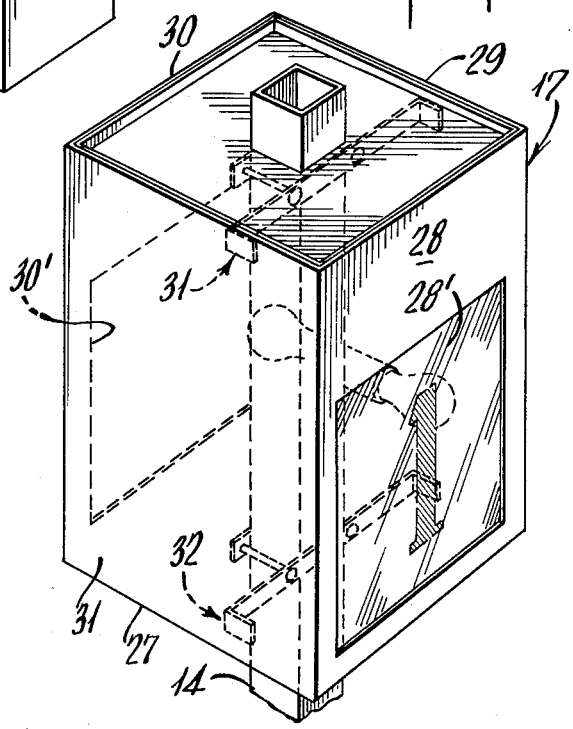
FIG. 2 is a perspective view of one of the indicia displaying lighting fixtures illustrated in FIG. 1.

Referring now to the drawings and more specifically to FIG. 1 which illustrates the plurality of check-out counters generally denoted by the numerals 11, 12 and 13. It will be observed that each counter is provided with a vertically disposed column denoted by the numerals 14, **14*a* and 14*b*. These columns are all substantially identical with the column 14 carrying an elongated indicia displaying light fixture 15 having a transluscent or transparent window 16 for carrying indicia to be displayed. The column 14*a* has a somewhat smaller light fixture 17 having a transluscent or transparent window 18. The column 14*b* has a light fixture 19 with transparent windows 20 and 21. It is evident that the transparent or transluscent windows on each of the lighting fixtures 15, 17 and 19 may be installed on one or more sides as desired. In connection with applications requiring task lighting, the fixtures 15, 17 and 19 may be supplemented by appropriate lighting fixtures such as spotlights, floodlights, general illuminating fixtures or the like. For instance, in the case of the column or post 14 if it is desired to provide added illumination on the counter 11, appropriate lighting fixtures could be affixed to the column beneath the lighting fixture 15** to case light downwardly on to the counter.

The upper end of each column 14 extends through the suspended ceiling shown in fragmentary form in FIG. 1 and denoted by the numeral 22. The upper end of the column in the instant embodiment of the invention carries a pair of electrical boxes 23 and 24 for the connection of power and communication cables which are in turn connected to outlets on the column by cables such as the flexible cable 25. The column is preferably secured to a longitudinal or transverse T-bar forming part of the suspended ceiling 22 by means of a suitable clamp assembly generally denoted by the numeral 26. The opening in the ceiling 22 through which the column 14 extends may be covered by a suitable canopy encircling the post and positioned against the ceiling.

The lighting fixtures 15, 17 and 19 as shown in FIG. 1 are all essentially similar but vary in height and cross section. It is evident however that the lighting fixture may be circular or eliptical in cross section depending on the desires of the user.

Figure 5:
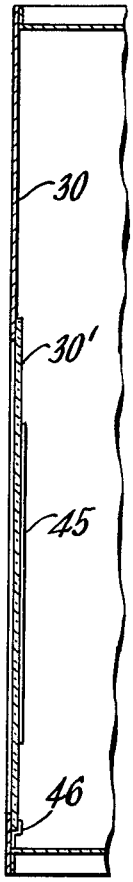
FIG. 5 is a cross sectional view of FIG. 3 taken along the line 5—5 thereof.
Figure 4:
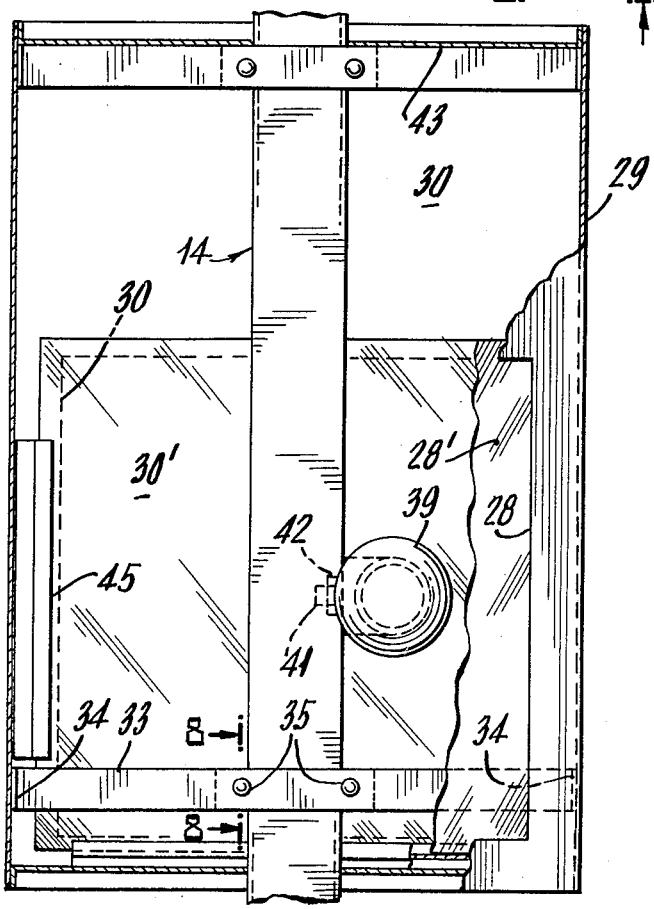
FIG. 4 is a cross sectional view of FIG. 3 taken along the line 4—4 thereof.

One embodiment of a typical lighting fixture is shown in FIGS. 2 through 5 and corresponds essentially to the lighting fixture 17 shown in FIG. 1. The fixture includes a rectangular housing 27 having side walls 28 through 31. The side walls 28 and 30 each include a transluscent or transparent window 28' and 30' respectively though it is understood that such windows may be on one or more sides of the structure. The fixture 27 is secured in position on the column 14 by a pair of bracket assemblies 31 and 32. The bracket assemblies are identical and therefore like numerals will be utilized to denote corresponding elements of each bracket. Each bracket consists of a transverse bar 33 having angularly disposed tabs 34 extending from the ends thereof and secured to the walls 29 and 31 by any suitable means such as spot welding, riveting or the like. A pair of bolts 35 extend through openings in the bar 33 and are spaced to accommodate the column 14 therebetween. A transverse bar 36 having a pair of spaced openings is placed over the ends of the bolts and is secured in place by a pair of wing nuts 37. A double socket 38 carrying a pair of light bulbs 39 is secured directly to the column 14 by a bracket 40 having a threaded tubular member 41 which extends through the wall of the tube 14 and is secured in place by a nut 42. The wires from the socket 38 extend through the tube 41 and are connected to conductors (not shown) within the column 14. The upper and lower ends of the lighting fixture 17 are closed by covers 43 and 44 which may be held in position by any suitable means. For instance, the covers may be held in place by small sheet metal screws or in the alternative the bottom cover 44 may be secured by spot welding, riveting or the like since there is ample access at the top to permit securing the fixture and the cover 43 merely placed in position. The windows 28' and 30' can be held in position as illustrated in FIG. 5. In this case, the wall 30 has brackets 45, 46 and 47 for slidably retaining transluscent or transparent windows such as the window in 30'.

Figure 6:
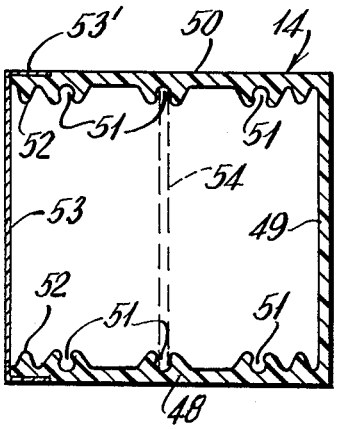
FIG. 6 is a cross sectional view of a column in accordance with the invention.
Figure 3:
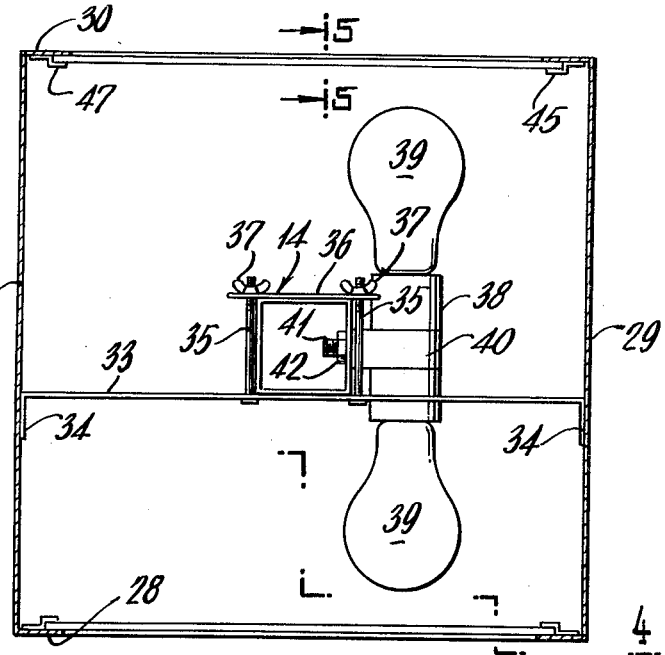
FIG. 3 is a cross sectional view of one of the lighting fixtures shown in FIG. 1 and taken along the line 3—3 thereof.

The column 14 is shown in cross section in FIG. 6 and has three integrally formed walls 48, 49 and 50 which form an essentially U-shaped structure. This portion of the column is preferably formed by the extrusion of a suitable material preferably aluminum and the walls 48 and 50 are formed with inwardly extending protrusions to form a plurality of vertically disposed channels 51. The free edges of the walls 48 and 50 are also provided with inwardly extending ribs 52 to receive and retain the fourth wall 53 which may be secured in place by any suitable means such as ribs 53' which overlap the ribs 52. The channels 51 which are aligned on opposing walls 48 and 50 are adapted to receive partition elements such as the partition 54 shown in FIG. 6. Partitions may be positioned in pairs of channels 51 and may even be arranged to engage diagonally disposed channels depending on how the space within the column is to be partitioned. The partitions are utilized to separate electrical conductors of different voltages and for different purposes. For instance, power lines may be housed in one section while computer and communicating cables would be housed in another section. In cases where receptacles having isolated grounds must be utilized, it is preferable to have the conductors for those cables separated from normal power supply cables. It is therefore evident that any variety of arrangements can be made within the column to accommodate the requirements of a particular situation.

Figure 7:
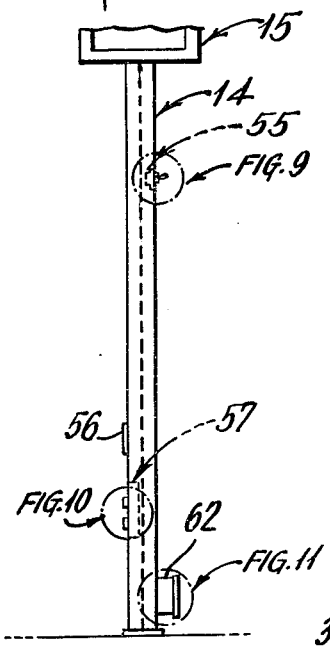
FIG. 7 is an elevational view of a column as illustrated in FIG. 1 and a portion of the lighting fixture carried thereby.
Figure 9:
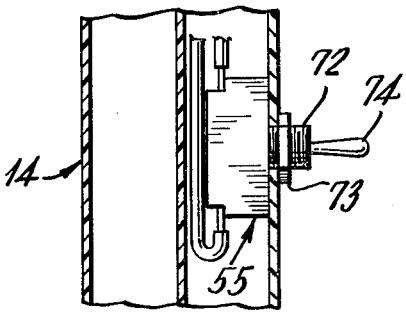
FIG. 9 is an enlarged cross sectional view of that portion of FIG. 7 denoted as FIG. 9.

FIG. 7 illustrates one embodiment of a column in accordance with the invention. In this instance, the column 14 is illustrated with the lighting fixture 15 secured thereto. The column is further provided with a switch 55 and outlets 56, 57 and 58. Details of the switch 55 are shown in FIG. 9. This switch is intended to control the lamps 39 mounted in the lighting fixture 15 and is a conventional toggle switch having a threaded shank 72 extending through a wall of the column 14 and secured by a nut 73. The handle 74 functions in a normal manner to open and close the switch.

Figure 10:
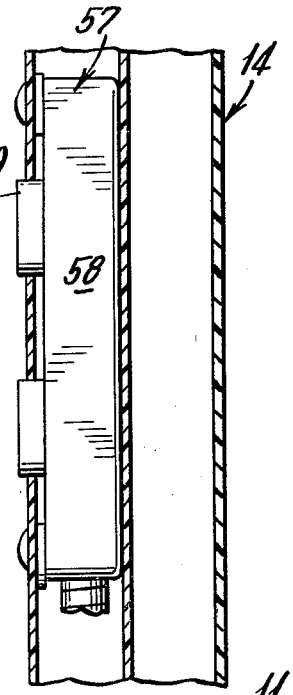
FIG. 10 is an enlarged cross sectional view of that portion of FIG. 7 denoted as FIG. 10.
Figure 8:
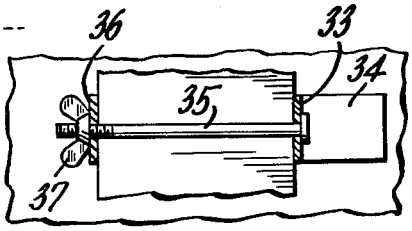
FIG. 8 is a cross sectional view of FIG. 4 taken along the line 8—8 thereof.

The outlet 56 may be a conventional connector such as that used for communication equipment as for instance telephone communication, public address communications, computer cables for computerized registers and the like. While only one such outlet is illustrated, it is apparent that a plurality of such outlets may be employed depending on the requirements. The outlet 57 is shown more clearly in FIG. 10 and may be utilized when a power outlet is required having an isolated ground. In this case, the outlet may be mounted within a separate housing 58 and the receptacles 59 and 60 are carried within the housing in order to completely isolate them from any grounded portions of the column 14. The outlet 58 (see FIG. 11) is a conventional outlet wherein the female receptacles 61 are housed within a metal box 62 and the latter is fastened to the surface of the column 14 by an angle connector 63 of conventional construction. The angle connector couples to the BX cable 64 extending from the upper end of the column and the conductors within the flexible cable 64 are connected to the female receptacles 61.

It will be observed in FIG. 7 that the outlets 57 and 58 are positioned on one side of the column 14 while the communication receptacle is on the opposing side. Accordingly, the low voltage of communication cable can be physically and electrically separated from the power cables connected to outlets by a partition such as the partition 54 shown in FIG. 6 and illustrated in phantom in FIG. 7.

Figure 11:
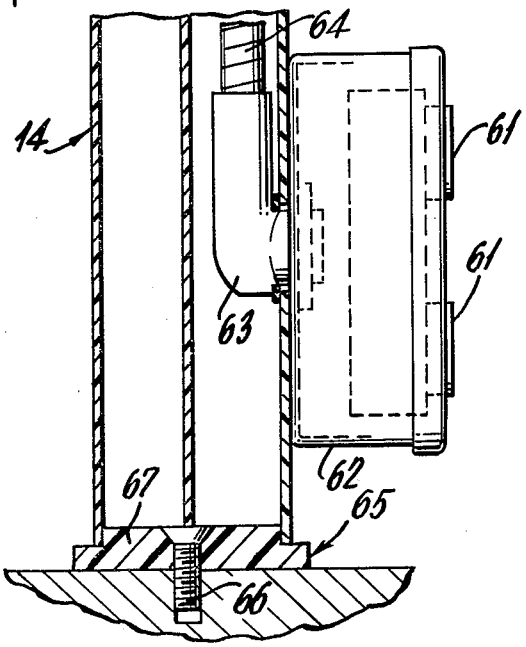
FIG. 11 is an enlarged cross sectional view of that portion of FIG. 7 denoted as FIG. 11 and illustrates one means for anchoring the column to the floor.
Figure 12:
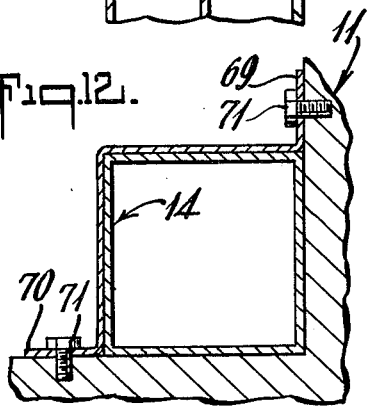
FIG. 12 is a cross sectional view of a column as illustrated in FIG. 1 showing one mode of securing it to the check-out counter.

FIGS. 11 and 12 illustrate two different types of mountings for supporting the bottom of the column. When the column 14 is to be secured to the floor, a plate 65 of rectangular configuration is secured to the floor by suitable means such as a screw or bolt 66. The plate 65 has a central rectangular section 67 which is adapted to fit within the bottom end of the column 14. While the weight of the column will normally hold it in engagement with the plate 65, suitable screws may be employed in order to provide a more secure attachment.

FIG. 12 illustrates an alternate mode of securing the bottom of the column 14 when used in a situation such as illustrated in FIG. 1. In this case, an L-shaped bracket 68 is provided with outwardly extending tabs 69 and 70 on the free ends. With this arrangement and with the column positioned in a corner of the counter as shown in FIG. 1, the bracket is placed in bridging relationship with the column 14 and is held in place by screws or bolts 71.

While only certain embodiments of the invention have been illustrated and described, it is apparent that alterations, modifications and changes may be made without departing from the true scope and spirit thereof.

What is claimed is:

1. A vertical utility and indicia displaying column for installation in areas having a suspended ceiling comprising an elongated rectangular tubular member, said tubular member including an elongated U-shaped structure having a pair of parallel wall portions joined one to the other by a third wall portion formed integrally therewith to form an elongated channel, said pair of parallel wall portions each carrying longitudinally disposed grooves on the inner surface thereof, said grooves being in alignment one with the other to slidably receive a partition, the upper end of said column extending upwardly through said ceiling and the bottom of said column including means for affixing it relative to the floor, a lamp housing surrounding a portion of said column and affixed thereto by a pair of vertically spaced bracket assemblies, each of said assemblies having a U-shaped portion surrounding three sides of said column and outwardly extending flanges on the ends of the legs of said U-shaped member and a transverse portion secured to said flanges, the ends of said transverse portion being secured to said housing, said housing including upper and lower covers and an opening in at least one wall thereof, a light transmitting indicia carrying plate closing said opening, an electric light source within said housing having insulated electric wires extending into said tubular member, at least one electric receptacle carried by said tubular member, electric conductors connected to said receptacle and said wires and extending through the upper end of said tubular member and means on said column for connection of communication equipment including telephones and computers.

* * * * *